US010435124B1

(12) United States Patent
Haynes et al.

(10) Patent No.: US 10,435,124 B1
(45) Date of Patent: Oct. 8, 2019

(54) COMPARTMENT BALLAST SYSTEM

(71) Applicant: GOODRICH CORPORATION, Charlotte, NC (US)

(72) Inventors: Timothy C Haynes, Prescott Valley, AZ (US); Michael A Luzader, Laveen, AZ (US)

(73) Assignee: GOODRICH CORPORATION, Charlotte, NC (US)

( * ) Notice: Subject to any disclaimer, the term of this patent is extended or adjusted under 35 U.S.C. 154(b) by 30 days.

(21) Appl. No.: 15/962,804

(22) Filed: Apr. 25, 2018

(51) Int. Cl.
*B63C 9/04* (2006.01)
*B63C 9/02* (2006.01)

(52) U.S. Cl.
CPC ..... *B63C 9/04* (2013.01); *B63C 2009/023* (2013.01); *B63C 2009/042* (2013.01)

(58) Field of Classification Search
CPC ..... B63C 9/04; B63C 2009/042; B63C 2009/023
See application file for complete search history.

(56) References Cited

U.S. PATENT DOCUMENTS

| | | | | |
|---|---|---|---|---|
| 3,092,854 | A * | 6/1963 | Manhart | B63C 9/02 441/38 |
| 4,187,570 | A * | 2/1980 | De Simone | B63C 9/06 244/138 R |
| 4,713,033 | A * | 12/1987 | Cameron | B63C 9/26 206/388 |
| 5,152,636 | A * | 10/1992 | Myers | E02B 15/08 405/68 |
| 5,197,821 | A * | 3/1993 | Cain | E02B 15/08 405/68 |
| 5,921,830 | A | 7/1999 | Shoaff, III | |
| 6,375,529 | B1 * | 4/2002 | Infante | B63C 9/04 441/38 |
| 8,382,541 | B1 * | 2/2013 | Campbell | B63C 9/04 114/349 |
| 9,227,707 | B2 | 1/2016 | Abeyta | |
| 2002/0166494 | A1 | 11/2002 | Inglis | |
| 2016/0173741 | A1 * | 6/2016 | Wolfenbarger | G03B 17/08 348/81 |
| 2019/0061887 | A1 * | 2/2019 | Volny | B63C 9/04 |

* cited by examiner

*Primary Examiner* — Stephen P Avila
(74) *Attorney, Agent, or Firm* — Snell & Wilmer, L.L.P.

(57) ABSTRACT

A life raft is disclosed. In various embodiments, the life raft includes a flotation platform, a container and a ballast bag, the ballast bag being attached to the flotation platform and to the container. The container is configured to separate upon deployment of the life raft on a surface of a body of water and draw the ballast bag down into the body of water upon separation.

20 Claims, 4 Drawing Sheets

COMPARTMENT BALLAST SYSTEM

FIELD

The present disclosure relates generally to inflating safety systems and, more particularly, to an inflatable life raft system having a ballast bag or other capsize resistant component of the system integrated with a storage compartment.

BACKGROUND

There are many types of inflatable life rafts in use today. One of the more popular types is a containerized raft, which is packed in a separable, one- or two-piece rigid container or compartment. For deployment, the containerized raft is thrown into the water where it is configured to float. A lanyard extending from the raft is pulled to open a valve connected to a cylinder containing air or carbon dioxide or a mixture of gases stored at high-pressure to inflate the raft. Inflation enlarges the raft to open the container or separate the container sections and render the raft ready for use. Following inflation of the raft, the opened container or separated container sections sink to the bottom under their own weight.

SUMMARY

A life raft is disclosed. In various embodiments, the life raft includes a flotation platform, a container and a first ballast bag attached to the flotation platform and to the container. The container is configured to separate upon deployment of the life raft on a surface of a body of water and draw the first ballast bag down into the body of water upon separation. In various embodiments, the flotation platform comprises a first inflation tube and the first ballast bag is attached to the flotation platform proximate an inner periphery of the first inflation tube. In various embodiments, the first ballast bag includes an outer periphery and the outer periphery of the first ballast bag is attached to the inner periphery of the first inflation tube.

In various embodiments, the container comprises a first container half and a second container half. In various embodiments, the first container half and the second container half are connected by a hinge. In various embodiments, the container is rectangular in cross section. In various embodiments, the first container half defines a first cavity and a first perimeter extending about the first cavity and the first ballast bag is attached to the first container half proximate a first portion of the first perimeter. In various embodiments, the second container half defines a second cavity and a second perimeter extending about the second cavity and the first ballast bag is attached to the second container half proximate a second portion of the second perimeter.

In various embodiments, the life raft includes a second ballast bag, the second ballast bag being attached to the flotation platform and to the container. In various embodiments, the container comprises a first container half and a second container half and the first ballast bag is attached to the first container half and the second bag is attached to the second container half. In various embodiments, the life raft further includes a third ballast bag, the third ballast bag being attached to the flotation platform and to the first container half, and a fourth ballast bag, the fourth ballast bag being attached to the flotation platform and to the second container half.

In various embodiments, the flotation platform includes a floor. In various embodiments, the flotation platform includes a first inflation tube and a second inflation tube secured to the first inflation tube. In various embodiments, a portion of each of the first ballast bag, the second ballast bag, the third ballast bag and the fourth ballast bag is attached to at least one of the floor, the first inflation tube and the second inflation tube.

A life raft is disclosed. In various embodiments, the life raft includes a flotation platform, a storage container, the storage container defining an interior cavity, and a ballast bag attached to the flotation platform and to at least a portion of the interior cavity of the storage container. The storage container is configured to separate upon deployment of the life raft on a surface of a body of water and draw the ballast bag down into the body of water upon separation. In various embodiments, the flotation platform comprises an inflation tube and at least a first portion of the ballast bag is secured to the inflation tube. In various embodiments, the flotation platform comprises a floor and at least a first portion of the ballast bag is secured to the floor. In various embodiments, the storage container comprises a first container half and a first portion of the ballast bag is attached to the first container half. In various embodiments, the storage container comprises a second container half and a second portion of the ballast bag is attached to the second container half.

A life raft is disclosed. In various embodiments, the life raft includes a flotation platform, a storage container, the storage container defining an interior cavity, and a ballast bag attached to the flotation platform and to the interior cavity of the storage container, the storage container being configured to separate upon deployment of the life raft on a surface of a body of water and draw the ballast bag down into the body of water upon separation.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

The following detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

Figure 1:
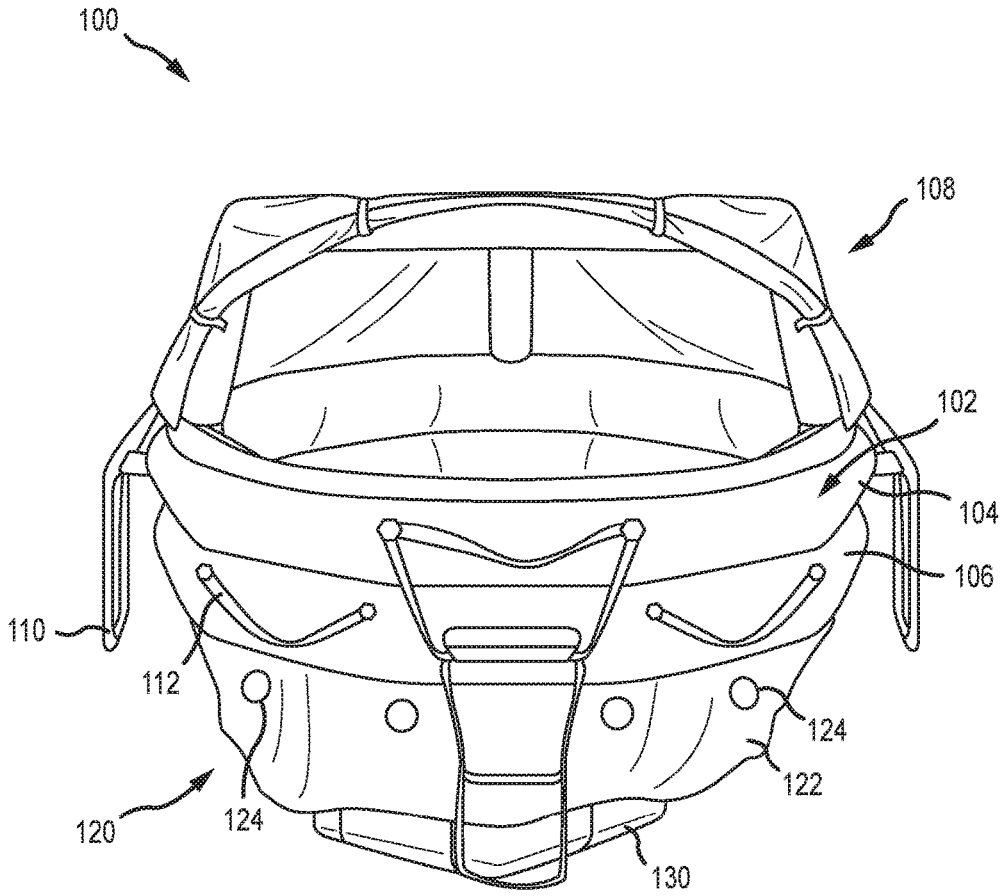
FIG. 1 is a perspective schematic view of a life raft in a deployed or an inflated state, in accordance with various embodiments.

Referring now to the drawings, FIG. 1 schematically illustrates a life raft 100 in a deployed or an inflated state, in accordance with various embodiments. The life raft 100 includes a flotation platform 102 for carrying and supporting at least one occupant. In various embodiments, the flotation platform 102 includes a buoyancy system such as, for example, a first inflation tube 104 and a second inflation tube 106. The first inflation tube 104 may be disposed above and suitably bonded to the second inflation tube 106. In various embodiments, one or both of the first inflation tube 104 and the second inflation tube 106 is compartmentalized such that the inflation tube comprises several segments or compartments extending about a circumference of the inflation tube. A flexible floor may be disposed at the bottom of the second inflation tube 106 and suitably bonded thereto. A canopy structure 108 may be disposed at the top of the first inflation tube 104 and suitably bonded thereto. In various embodiments, one or more ladders 110 or straps 112 may be positioned on or secured to one or both of the first inflation tube 104 and the second inflation tube 106.

Still referring to FIG. 1, the life raft 100 includes a ballast system 120. In various embodiments, the ballast system 120 includes a ballast bag 122. The ballast bag 122 includes one or more ports 124 to allow water—e.g., sea water—to flow into an interior portion of the ballast bag 122. In various embodiments, a plurality of ports is spaced circumferentially about the exterior surface of the ballast bag 122. Once the ballast bag 122 is filled with water, the life raft 100 becomes more stable in response to wind and waves and, as a result, better able to resist rolling movement and to facilitate climbing into the life raft 100 via the one or more ladders 110. Without such stabilization, the life raft 100 may, in various situations, be prone to capsize or expose occupants to conditions of excessive rolling that may lead to seasickness. The ballast system 120 further includes a container 130, as will be described in further detail below. In various embodiments, the container 130 is suitably bonded to a lower section of the ballast bag 122 and, upon deployment of the life raft 100, acts as a weight to keep the ballast bag 122 and, more specifically, the one or more ports 124, positioned below the water surface to expedite filling of the ballast bag 122 with water.

Figure 2A:
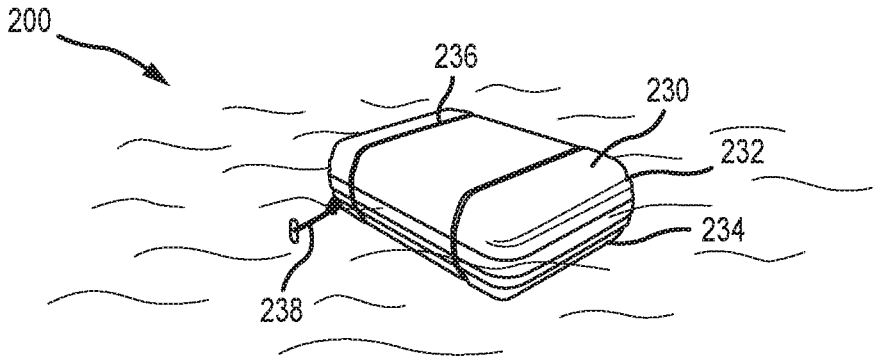
FIGS. 2A, 2B, 2C, 2D and 2E are perspective schematic views of a life raft undergoing inflation from a stowed or an uninflated state to a deployed or an inflated state, in accordance with various embodiments.

Referring now to FIGS. 2A-2E, a series of illustrations depicts various stages of inflation of a life raft 200, in accordance with various embodiments. Referring to FIG. 2A, more specifically, the life raft 200 is shown floating on a surface of a body of water—e.g., the surface of a lake or ocean. As illustrated, the life raft 200 includes a container 230. In various embodiments, the container 230 is suitcase-like, in that the container 230 includes a first container half 232 and a second container half 234. In various embodiments, the first container half 232 and the second container half 234 are connected by one or more hinges, much like occurs with a suitcase. One or more breakable straps 236 may be used to secure the first container half 232 and the second container half 234 together while the life raft 200 assumes a stowed state. While the life raft 200 may be designed to activate automatically upon contact with the surface of the body of water, in various embodiments, a cord 238 is included for manual operation.

Figure 2B:
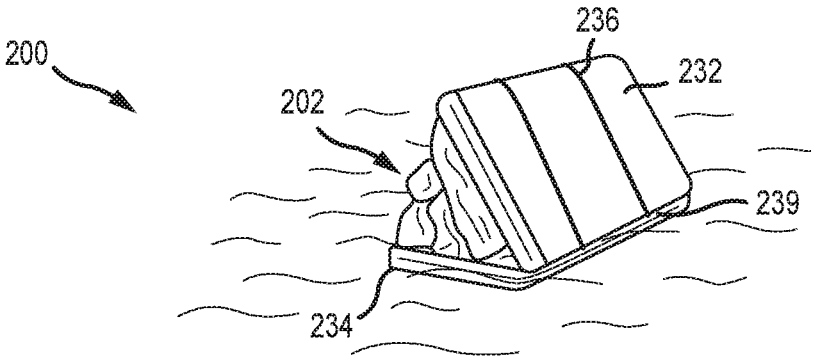
Figure 2C:
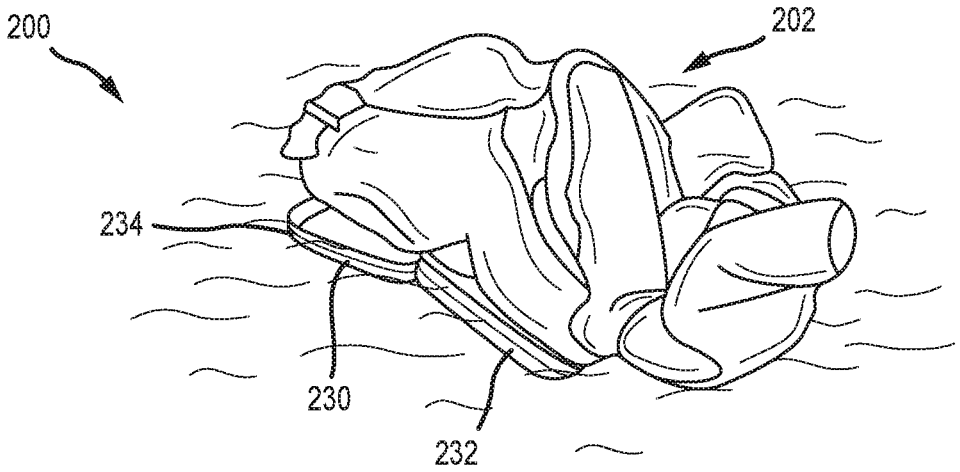

Referring now to FIG. 2B, the life raft 200 is illustrated during a first stage of deployment. The life raft 200 has been activated—either automatically or manually—to release a source of high-pressure gas into a flotation platform 202. Inflation of the flotation platform 202 urges the first container half 232 and the second container half 234 apart from one another. In various embodiments, the first container half 232 and the second container half 234 are attached to one another by one or more hinges 239 that may be positioned on one side of the container 230. Accordingly, as the flotation platform 202 separates, the one or more breakable straps 236 fracture and the first container half 232 and the second container half 234 open about the one or more hinges 239. As illustrated in FIG. 2C, the inflation process continues to a second stage, whereat the container 230—e.g., the first container half 232 and the second container half 234—is fully open with the flotation platform 202 continuing to inflate.

Figure 2D:
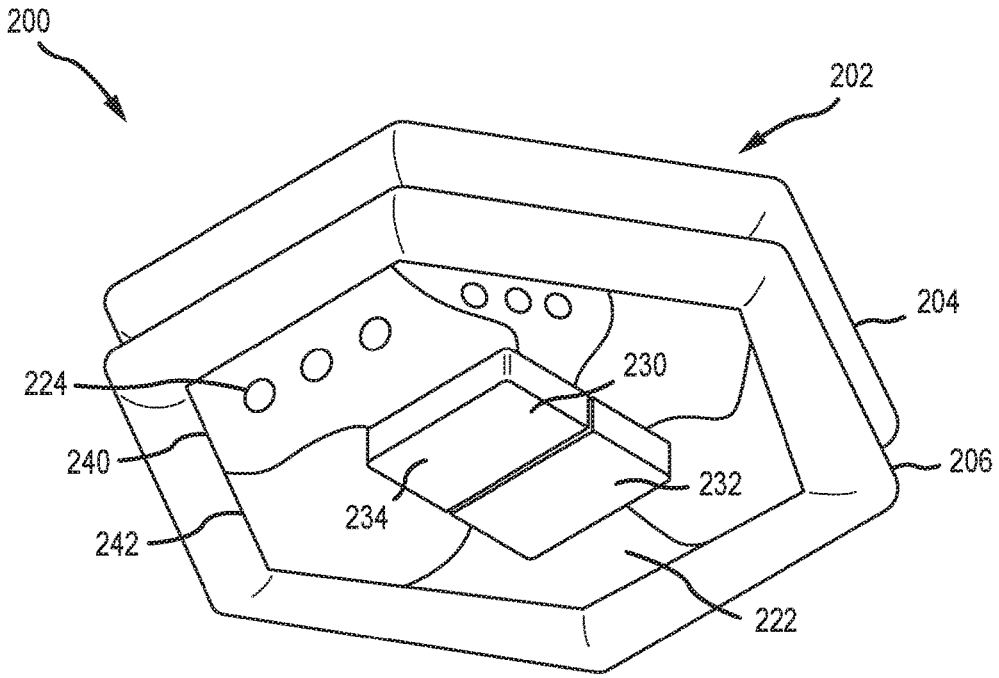

Referring now to FIG. 2D, deployment of the life raft 200 has reached a stage of the inflation process where the flotation platform 202 is fully inflated. In various embodiments, the flotation platform 202 is configured in the form of a first inflation tube 204 and a second inflation tube 206, with the second inflation tube 206 bonded to and disposed below the first inflation tube 204. As illustrated in FIG. 2D, while the flotation platform 202 is fully inflated, or nearing such state of full inflation, a ballast bag 222 disposed below the second inflation tube 206 has yet to fully deploy. In various embodiments, the ballast bag 222 includes an outer periphery 240 that is suitably bonded to the flotation platform 202. For example, the outer periphery 240 of the ballast bag 222 may be bonded to a lower or inside surface 242 extending about an inside periphery of the second inflation tube 206. As further illustrated, the container 230 is attached to the ballast bag 222 using any suitable manner of attachment. The container 230 is constructed of one or more materials that are more dense than water and will thus sink, dragging the attached portion of the ballast bag 222 along with it.

Figure 2E:
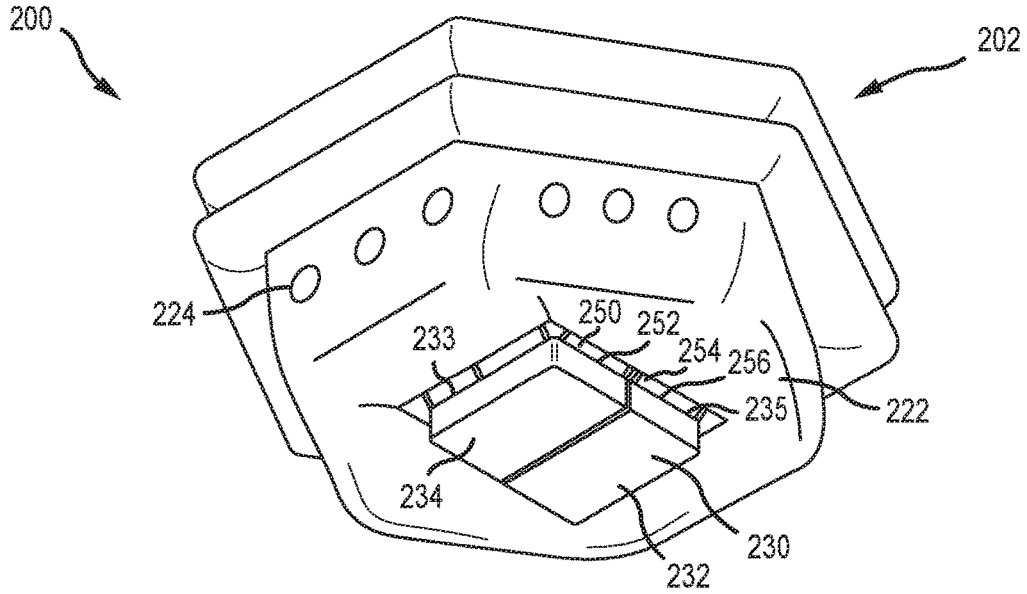

Finally, as illustrated in FIG. 2E, the life raft 200 is illustrated in a fully deployed state. The flotation platform is fully inflated with gas and the ballast bag 222 is fully filled with water. During the process of filling the ballast bag 222, the container 230 sinks in the water to the depth of the ballast bag 222. The weight of the container 230 not only tends to pull the ballast bag 222 down into the water, but also tends to pull a plurality of ports 224 that provide openings for water to flow into the interior of the ballast bag 222 below the surface of the water. Pulling the plurality of ports 224 below the surface of the water expedites the flow of water into the interior of the ballast bag 222 and thereby expedites deployment of the life raft 200.

In various embodiments, the ballast bag 222 is connected to both the first container half 232 and the second container half 234. In various embodiments, the first container half 232 defines a first cavity within the first container half 232 and a first perimeter 233 that extends about the first cavity. In various embodiments, the ballast bag 222 is attached to the first container half 232 by bonding one or more portions of the ballast bag 222 to one or more portions of the first perimeter 233 of the first container half 232. For example, in various embodiments, a first portion 250 of the ballast bag 222 may be bonded to a first portion or side 252 of the first container half 232. In various embodiments, various portions of the ballast bag 222 may be bonded to and about a substantial entirety of the first perimeter 233 of the first container half 232. In various embodiments, a portion of the ballast bag 222 may be bonded to an interior portion of the first cavity of the first container half 232. In various embodiments, the bonding referred to above and below is achieved by using a suitable adhesive between surfaces of the ballast bag 222 and the first container half 232. In various embodiments, the attachment may be achieved by bonding or sewing or by any other suitable manner of connecting or joining the two components together.

Similarly, in various embodiments, the second container half 234 defines a second cavity within the second container half 234 and a second perimeter 235 that extends about the second cavity. In various embodiments, the ballast bag 222 is attached to the second container half 234 by bonding one or more portions of the ballast bag 222 to one or more portions of the second perimeter 235 of the second container half 234. For example, in various embodiments, a second portion 254 of the ballast bag 222 may be bonded to a second portion or side 256 of the second container half 234. In various embodiments, various portions of the ballast bag 222 may be bonded to and about a substantial entirety of the second perimeter 235 of the second container half 234. In various embodiments, a portion of the ballast bag 222 may be bonded to an interior portion of the second cavity of the second container half 234.

Figure 3:
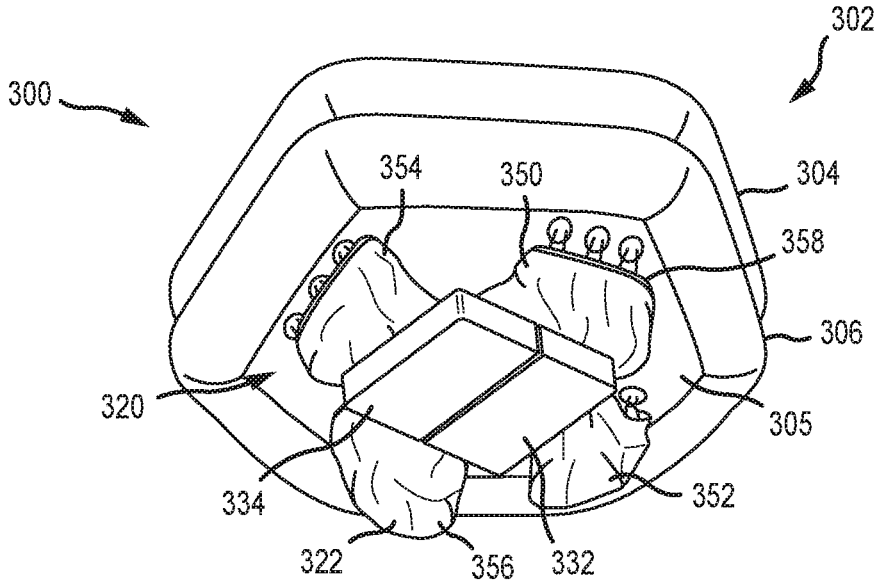
FIG. 3 is an underside perspective schematic view of a life raft in a deployed state in accordance with various embodiments.

Referring now to FIG. 3, a life raft 300 in a deployed state is illustrated, according to various embodiments. The life raft 300 includes a flotation platform 302 for carrying and supporting at least one occupant. In various embodiments, the flotation platform 302 includes a buoyancy system such as, for example, a first inflation tube 304 and a second inflation tube 306. The first inflation tube 304 may be disposed above and suitably bonded to the second inflation tube 306. In various embodiments, one or both of the first inflation tube 304 and the second inflation tube 306 is compartmentalized such that the inflation tube comprises several segments or compartments extending about a circumference of the inflation tube. A floor 305 may be disposed proximate the bottom of the second inflation tube 306 and suitably bonded thereto. As described above with respect to FIG. 1, in various embodiments, the life raft 300 may include a canopy structure or one or more ladders or straps positioned on or secured to one or both of the first inflation tube 304 and the second inflation tube 306.

Still referring to FIG. 3, the life raft 300 includes a ballast system 320. In various embodiments, the ballast system 320 includes one or more ballast bags 322. For example, in various embodiments, the life raft 300 may include a first ballast bag 350, a second ballast bag 352, a third ballast bag 354 and a fourth ballast bag 356. In various embodiments, one or more of the first, second, third and fourth ballast bags are secured to the floor 305 of the life raft 300. In various embodiments, one or more of the first, second, third and fourth ballast bags are secured to the second inflation tube 306 of the life raft 300, or both the first inflation tube 304 and the second inflation tube 306. In various embodiments, one or more of the first, second, third and fourth ballast bags comprise an open bag, having an opening 358 at an upper portion of the ballast bag to allow water—e.g., sea water—to flow into an interior portion of the ballast bag. Once the ballast bag—e.g., one or more of the first ballast bag 350, the second ballast bag 352, the third ballast bag 354 and the fourth ballast bag 356—is filled with water, the life raft 300 becomes more stable in response to wind and waves and, as a result, better able to resist rolling movement and to facilitate climbing into the life raft 300 via the one or more ladders. In various embodiments, each of the one or more of the first ballast bag 350, the second ballast bag 352, the third ballast bag 354 and the fourth ballast bag 356 is connected to a first container half 332 or to a second container half 334, similar to that described above with reference to FIG. 2E. For example, in various embodiments, the first ballast bag 350 and the second ballast bag 352 may be attached or bonded to the first container half 352 (either to an interior surface within the cavity of the container half or to a perimeter surrounding the cavity) while the third ballast bag 354 and the fourth ballast bag 356 may be attached or bonded to the second container half 334. The attachment or bonding of the various ballast bags to the container halves may be achieved in a manner similar to that described above with reference to FIG. 2E.

Figure 4:
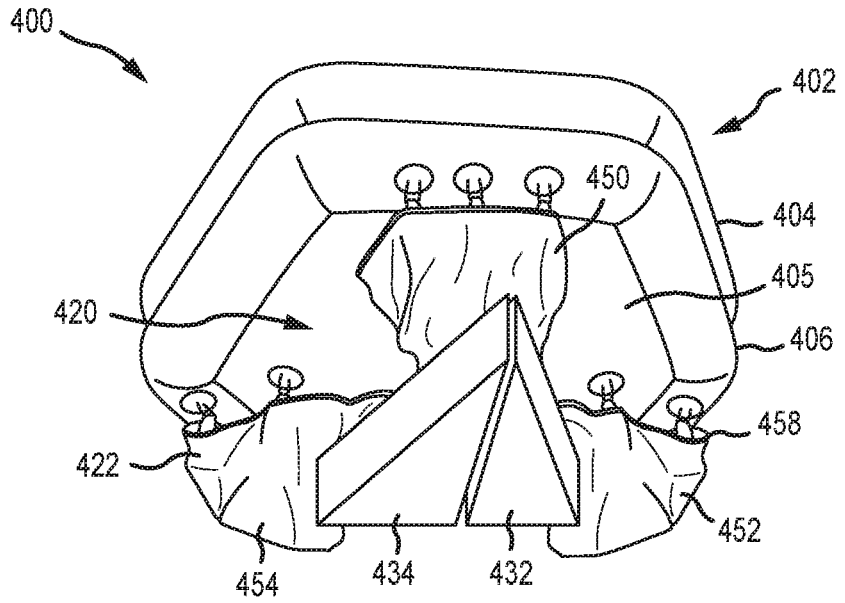
FIG. 4 is an underside perspective schematic view of a life raft in a deployed state in accordance with various embodiments.

Referring now to FIG. 4, a life raft 400 in a deployed or an inflated state is illustrated, according to various embodiments. The life raft 400 includes a flotation platform 402 for carrying and supporting at least one occupant. In various embodiments, the flotation platform 402 includes a buoyancy system such as, for example, a first inflation tube 404 and a second inflation tube 406, similar to the flotation platform and inflation tubes described above. A floor 405 may be disposed proximate the bottom of the second inflation tube 406 and suitably bonded thereto. As described above with respect to FIG. 1, in various embodiments, the life raft 400 may include a canopy structure or one or more ladders or straps positioned on or secured to one or both of the first inflation tube 404 and the second inflation tube 406.

The life raft 400 includes a ballast system 420 similar to the systems described above, with reference to FIG. 3. In various embodiments, the ballast system 420 includes one or more ballast bags 422. For example, in various embodiments, the life raft 400 may include a first ballast bag 450, a second ballast bag 452 and a third ballast bag 454. In various embodiments, one or more of the first, second and third ballast bags are secured to the floor 405 of the life raft 400. In various embodiments, one or more of the first, second and third ballast bags are secured to the second inflation tube 406 of the life raft 400, or both the first inflation tube 404 and the second inflation tube 406. In various embodiments, one or more of the first, second and third ballast bags are secured to both the floor 405 and the second inflation tube 406 of the life raft 400. As illustrated in FIG. 4, each of the one or more ballast bags 422 share the same structural and functional characteristics as do the one or more ballast bags 322 described above with reference to FIG. 3, including having an opening 458 at an upper portion of the ballast bag.

In various embodiments, each of the one or more of the first ballast bag 450, the second ballast bag 452 and the third ballast bag 454 is connected to a first container half 432 or to a second container half 434, similar to that described above with reference to FIGS. 2E and 3. For example, in various embodiments, the first ballast bag 450 and the second ballast bag 452 may be attached or bonded to the first container half 452 (either to an interior surface within the cavity of the container half or to a perimeter surrounding the cavity) while the first ballast bag 450 and the third ballast bag 354 may be attached or bonded to the second container half 434. As illustrated, the first container half 432 and the second container half 434 may have triangular cross sections, as opposed to the rectangular cross sections above described. The triangular cross section may facilitate storage and deployment of the life raft 400 in embodiments where an odd number of ballast bags is used. The attachment or bonding of the various ballast bags to the container halves may be achieved in a manner similar to that described above with reference to FIG. 2E.

Finally, it should be understood that any of the above described concepts can be used alone or in combination with any or all of the other above described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible in light of the above teaching.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A life raft, comprising:
a flotation platform;
a container; and
a first ballast bag attached to the flotation platform and to the container,
wherein the container is configured to separate upon deployment of the life raft on a surface of a body of water and draw the first ballast bag down into the body of water upon separation.

2. The life raft of claim 1, wherein the flotation platform comprises a first inflation tube and wherein the first ballast bag is attached to the flotation platform proximate an inner periphery of the first inflation tube.

3. The life raft of claim 2, wherein the container comprises a first container half and a second container half.

4. The life raft of claim 3, wherein the first container half and the second container half are connected by a hinge.

5. The life raft of claim 4, wherein the container is rectangular in cross section.

6. The life raft of claim 2, wherein the first ballast bag includes an outer periphery and wherein the outer periphery of the first ballast bag is attached to the inner periphery of the first inflation tube.

7. The life raft of claim 3, wherein the first container half defines a first cavity and a first perimeter extending about the first cavity and wherein the first ballast bag is attached to the first container half proximate a first portion of the first perimeter.

8. The life raft of claim 7, wherein the second container half defines a second cavity and a second perimeter extending about the second cavity and wherein the first ballast bag is attached to the second container half proximate a second portion of the second perimeter.

9. The life raft of claim 1, further comprising a second ballast bag, the second ballast bag attached to the flotation platform and to the container.

10. The life raft of claim 9, wherein the container comprises a first container half and a second container half and wherein the first ballast bag is attached to the first container half and the second ballast bag is attached to the second container half.

11. The life raft of claim 10, further comprising a third ballast bag, the third ballast bag attached to the flotation platform and to the first container half, and a fourth ballast bag, the fourth ballast bag attached to the flotation platform and to the second container half.

12. The life raft of claim 11, wherein the flotation platform includes a floor.

13. The life raft of claim 12, wherein the flotation platform includes a first inflation tube and a second inflation tube attached to the first inflation tube.

14. The life raft of claim 13, wherein a portion of each of the first ballast bag, the second ballast bag, the third ballast bag and the fourth ballast bag is attached to at least one of the floor, the first inflation tube and the second inflation tube.

15. A life raft system, comprising:

a flotation platform;

a storage container, the storage container defining an interior cavity; and a ballast bag attached to the flotation platform and to at least a portion of the interior cavity of the storage container, wherein the storage container is configured to separate upon deployment of the life raft on a surface of a body of water and draw the ballast bag down into the body of water upon separation.

16. The life raft system of claim 15, wherein the flotation platform comprises an inflation tube and wherein at least a first portion of the ballast bag is attached to the inflation tube.

17. The life raft system of claim 15, wherein the flotation platform comprises a floor and wherein at least a first portion of the ballast bag is attached to the floor.

18. The life raft system of claim 15, wherein the storage container comprises a first container half and wherein a first portion of the ballast bag is attached to the first container half.

19. The life raft system of claim 18, wherein the storage container comprises a second container half and wherein a second portion of the ballast bag is attached to the second container half.

20. A life raft, comprising:

a flotation platform;

a storage container, the storage container defining an interior cavity; and a ballast bag attached to the flotation platform and to the interior cavity of the storage container, wherein the storage container is configured to separate upon deployment of the life raft on a surface of a body of water and draw the ballast bag down into the body of water upon separation.

* * * * *